United States Patent [19]

Phares

[11] 4,307,481

[45] Dec. 29, 1981

[54] FLEXIBLE DRYWALL CONTOURING AND JOINT FINISHING TOOL

[76] Inventor: Gary L. Phares, 118 Chestnut St., Elkins, W. Va. 26241

[21] Appl. No.: 75,168

[22] Filed: Sep. 12, 1979

[51] Int. Cl.[3] ..... B05C 17/10

[52] U.S. Cl. ..... 15/235.4; 15/104 S

[58] Field of Search ..... 15/235.4, 235.5, 235.6, 15/235.7, 235.8, 104 S; 401/139; 7/105; D8/45

[56] References Cited

U.S. PATENT DOCUMENTS 1,261,844 4/1918 Orr ..... 15/104 S 2,773,377 12/1956 Squire ..... 15/235.4

3,101,502 8/1963 Levy ..... 15/235.4

*Primary Examiner*—Edward L. Roberts

*Attorney, Agent, or Firm*—Dressler, Goldsmith, Shore, Sutker & Milnamow

[57] ABSTRACT

A flexible drywall contouring and joint finishing tool is constituted by an elongated strip of spring sheet metal which is longitudinally bent to provide an elongated flexible straight-edged smoothing blade and a spring handle constituted by a handplate connected to said blade by a relatively large diameter bend providing a spring action and a stiffening element connected to said handplate by a relatively small diameter bend providing a finger-grasping edge.

7 Claims, 2 Drawing Figures

FLEXIBLE DRYWALL CONTOURING AND JOINT FINISHING TOOL

TECHNICAL FIELD

This invention relates to a hand tool for contouring and finishing the joints between sections of drywall.

BACKGROUND ART

In the construction of drywalls, sections of drywalls are fitted together over supporting studs, a tape is applied over the joints, and several coats of a cementitious mixture are applied with a trowel over the taped joints between adjacent sections. The cementitious mixture is a sticky mass which spreads easily when troweled. The drywall itself is usually sheetrock. The problem is to smooth the cementitious mixture to provide a smooth surface (a lap-free joint). Several parallel joints present a frequent problem, and these should be finished at the same time.

At the present time, this finishing task is done with the trowel, but the work is slow and the result is inadequate because of the lap marks produced by the trowel strokes. Also, the trowel tends to remove too much of the cementitious material in the effort to get it smooth, and this leads to greater shrinkage as the cementitious material dries.

DISCLOSURE OF THE INVENTION

In this invention, a flexible drywall contouring and joint finishing tool is formed by longitudinally bending an elongated sheet of spring metal. The result is similar to a plasterer's darby, but a darby must be stiff since it functions to level the plaster. A drywall is not level, so the tool must be flexible.

The sheet of spring metal is rectangular and has a length of from about 2 to about 4 feet, and it is bent longitudinally to provide an elongated flexible straight-blade having a width of about 3½ to about 8 inches, and a spring handle. This spring handle is constituted by a handplate connected to the blade by a relatively large diameter bend which provides a spring action and by a stiffening element which is connected to the handplate by a relatively small diameter bend which provide a finger-grasping edge.

The finishing tool is grasped by both hands with the finger tips on the finger grasping edge and with the thumbs under the large diameter bend and the smoothing blade is pressed against the drywall and moved laterally to cause the blade to conform with the contour of the drywall and to cause the straight edge to move along the length of the joints to be finished whereby the cementitious material is wiped smooth without lap marks. Only minimal manipulative skill is needed.

BEST MODE FOR CARRYING OUT THE INVENTION

The invention will be more fully understood from the accompanying drawings in which.

Figure 1:
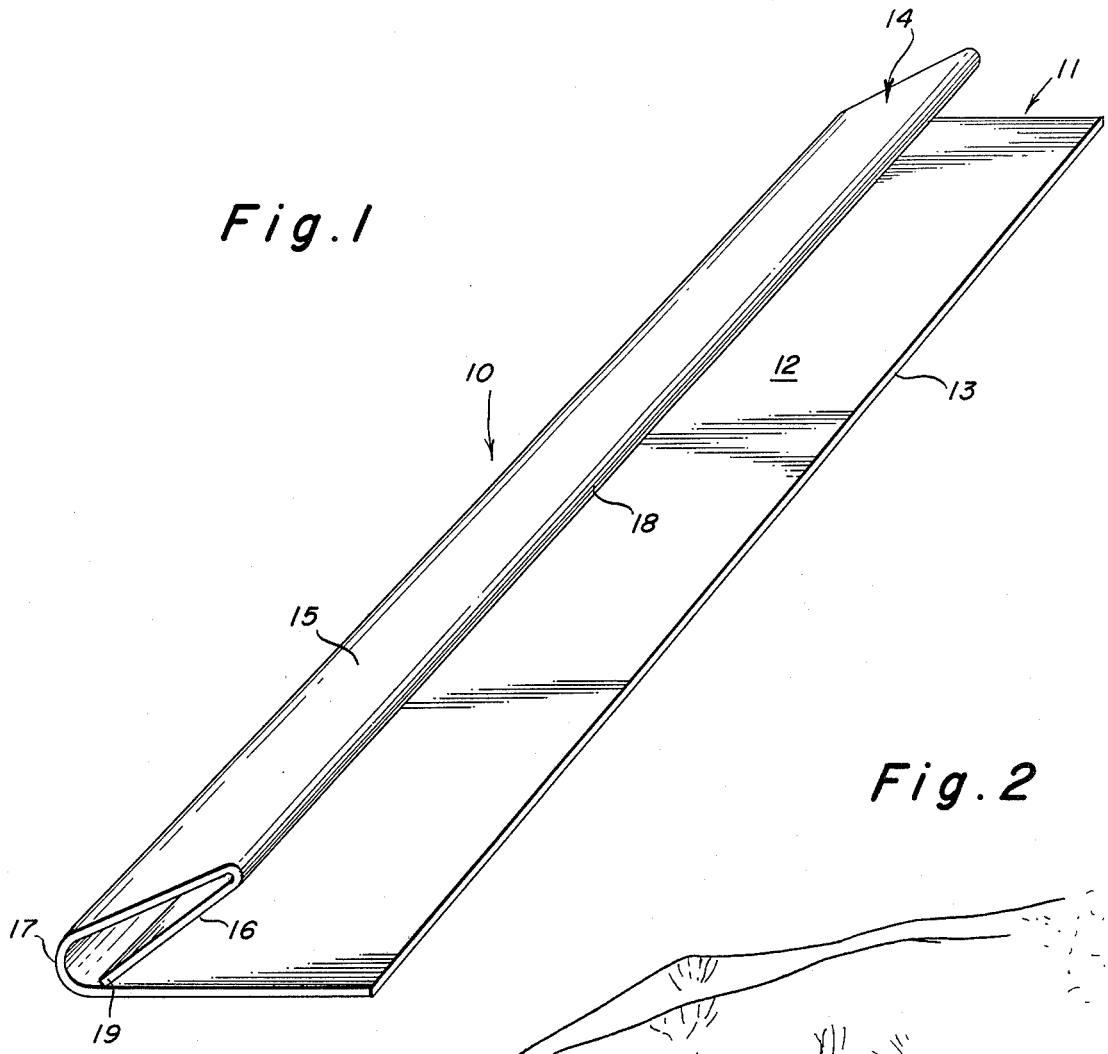
FIG. 1 is a perspective view of the joint finishing tool.

Referring more particularly to the drawings, the finishing tool 10 of this invention is formed by longitudinally bending a rectangular strip of spring sheet metal

11 having a length of from about 2 to about 4 feet, preferably 2½–3½ feet. These longitudinal bends provide an elongated flexible smoothing blade 12 having a straight edge 13. The blade 12 must be both longitudinally and laterally flexible to allow it to conform with the surface of the wall being finished, and also to provide the desired pressure against the cementitious material.

The desired flexibility is obtained using spring sheet metal of from 12–30 gauge, preferably from 16–20 gauge. The edge 13 should be straight and smooth and abrasion resistant, so stainless steel is particularly contemplated, but other springy metals can also be used, such as steel, tinplated steel, or aluminum.

The smoothing blade should have a width of from about 3½ to about 8 inches, preferably from 4–6 inches, in order to be wide enough to allow the thumb to protrude and narrow enough to be handleable.

The longitudinal bends provide a spring handle 14 which runs the length of the strip. This spring handle is constituted by a handplate 15 which is sized to permit it to be grasped by the hand and by a stiffening element 16 which extends back toward the blade 12.

The handplate 15 is connected to the blade 12 by a relatively large diameter bend 17 which provides a spring action for the spring handle 14. The diameter of bend 17 will conveniently vary from ¼ to ⅞ inch, preferably ⅜ to ¾ inch. A smooth bend is preferred.

The stiffening element 16 is connected to the handplate 15 by a relatively narrow bend 18 which is conveniently about ⅛–⅜ inch in diameter.

Figure 2:
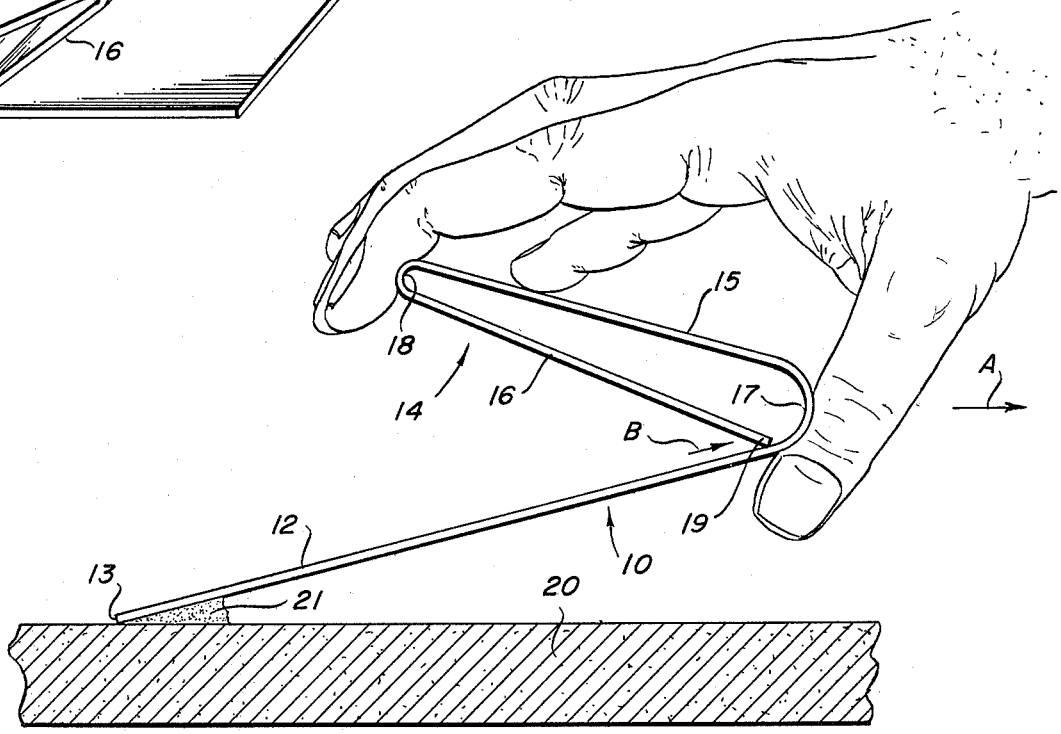
FIG. 2 is a side elevation of the tool showing how it is held by the hand and how it is positioned and moved to smooth and contour the cementitious material previously applied to one or more drywall joints.

Turning to FIG. 2, the finishing tool 10 is grasped by both hands, only one being shown since both hands are similarly positioned along the length of the tool. As can be seen, the finger tips engage bend 18 which thus provides a finger-grasping edge. The thumb underlies bend 17. The tool is supported at an acute angle to the wall 20 and is pressed toward the wall to cause the tool to bend longitudinally and to flex the blade 12 against the wall to properly smooth the previously applied cementitious material. The tool is then moved along the line of the joints being finished, this movement being shown by Arrow A. Excess cementitious material accumulates as shown at 21, and is wiped off after the tool is used.

Returning to FIG. 1, the stiffening element 16 preferably extends toward the bend 17 so that the edge 19 of the element 16 bears against the rear face of the blade adjacent the bend 17. As can be seen in FIG. 2, when the spring handle 14 is forced toward the wall 20, edge 19 moves as indicated by arrow B. This limits the extent to which the handle 14 will flex.

In a particularly preferred embodiment, the finishing tool is formed of stainless steel having a gauge of 16 or 20 gauge, and the tool is 3 feet in length. The smoothing blade has a width of 5 inches and the handplate has a width of 3 inches and is connected to the blade by a ½ in. diameter bend. The angle between the blade and the handplate is about 30°. The stiffening element is connected to the handplate by a bend of 3/16 inches in diameter and the stiffening element extends back and bears against the smoothing blade immediately adjacent the relatively large diameter bend.

I claim:

1. A flexible drywall contouring and joint finishing tool constituted by an elongated strip of spring sheet metal having a length of from about 2 to about 4 feet and longitudinally bent to provide an elongated flexible straight-edged smoothing blade having a width of about $3\frac{1}{2}$ to about 8 inches, and a spring handle constituted by a handplate connected to said blade by a relatively large diameter bend providing a spring action and a stiffening element connected to said handplate by a relatively small diameter bend providing a finger-grasping edge, said small diameter bend being spaced from said large diameter bend a distance sufficient to size said handplate to permit it to be grasped by the hand with the finger tips on said grasping edge and with the thumbs under said large diameter bend.

2. A finishing tool as recited in claim 1 in which said sheet metal is stainless steel.

3. A finishing tool as recited in claim 1 in which said stainless steel has a thickness of from 12 to 30 gauge.

4. A finishing tool as recited in claim 1 in which said relatively large diameter bend has a diameter of from $\frac{1}{4}$ to $\frac{7}{8}$ inch.

5. A finishing tool as recited in claim 1 in which said relatively small diameter bend has a diameter of from $\frac{1}{8}$ to $\frac{3}{8}$ inch.

6. A flexible drywall contouring and joint finishing tool constituted by an elongated strip of spring sheet metal having a length of from about 2 to about 4 feet and longitudinally bent to provide an elongated flexible straight-edged smoothing blade having a width of about $3\frac{1}{2}$ to about 8 inches, and a spring handle constituted by a handplate connected to said blade by a relatively large diameter bend providing a spring action and a stiffening element connected to said handplate by a relatively small diameter bend providing a finger-grasping edge, the free end of said stiffening element extending toward and bearing against the rear face of said blade adjacent said relatively large diameter bend.

7. A finishing tool as recited in claim 6 in which said strip of sheet metal is $2\frac{1}{2}$–$3\frac{1}{2}$ feet in length, said blade is 4–6 inches in width, said large diameter bend is about $\frac{3}{8}$–$\frac{3}{4}$ inch in diameter, and said small diameter bend is about $\frac{1}{8}$–$\frac{3}{8}$ inch in diameter.

* * * * *